US008754775B2

(12) United States Patent
Holcombe

(10) Patent No.: US 8,754,775 B2
(45) Date of Patent: Jun. 17, 2014

(54) USE OF OPTICAL REFLECTANCE PROXIMITY DETECTOR FOR NUISANCE MITIGATION IN SMOKE ALARMS

(75) Inventor: Wayne T. Holcombe, Mountain View, CA (US)

(73) Assignee: Nest Labs, Inc., Palo Alto, CA (US)

( * ) Notice: Subject to any disclaimer, the term of this patent is extended or adjusted under 35 U.S.C. 154(b) by 777 days.

(21) Appl. No.: 12/727,983

(22) Filed: Mar. 19, 2010

(65) Prior Publication Data

US 2010/0238036 A1 Sep. 23, 2010

Related U.S. Application Data

(60) Provisional application No. 61/162,193, filed on Mar. 20, 2009.

(51) Int. Cl.
*G08B 17/10* (2006.01)

(52) U.S. Cl.
USPC ..... 340/629; 340/628; 340/630; 340/309.16; 73/23.33; 73/23.35; 73/35.01; 250/200; 250/554; 116/67 R; 116/101; 116/216

(58) Field of Classification Search
USPC ..... 340/628–630, 577–584, 587, 309.16, 340/527; 73/23.33, 23.35, 53.01; 250/554, 250/200; 356/441; 116/101, 216, 67 R
See application file for complete search history.

(56) References Cited

U.S. PATENT DOCUMENTS 2,101,637 A 12/1937 Davis
3,934,145 A * 1/1976 Dobrzanski et al. ..... 250/381
3,991,357 A 11/1976 Kaminski
4,183,290 A 1/1980 Kucharczyk
4,223,831 A 9/1980 Szarka
4,257,039 A * 3/1981 Webb et al. ..... 340/629
4,313,110 A * 1/1982 Subulak et al. ..... 340/527
4,335,847 A 6/1982 Levine
4,408,711 A 10/1983 Levine
4,615,380 A 10/1986 Beckey
4,674,027 A 6/1987 Beckey
4,685,614 A 8/1987 Levine
4,751,961 A 6/1988 Levine et al.

(Continued)

FOREIGN PATENT DOCUMENTS

CA 2202008 2/2000
EP 196069 12/1991

(Continued)

OTHER PUBLICATIONS

Aprilaire Electronic Thermostats Model 8355 User's Manual, Research Products Corporation, Dec. 2000, 16 pages.

(Continued)

*Primary Examiner* — Steven Lim
*Assistant Examiner* — Sisay Yacob
(74) *Attorney, Agent, or Firm* — Kilpatrick Townsend & Stockton LLP

(57) ABSTRACT

A smoke alarm comprises smoke detection circuitry for detecting smoke and generating a detection signal responsive thereto. Proximity detection circuitry generates a proximity detection signal responsive to detection of an object within in a selected distance of the smoke alarm. Alarm generation circuitry generates an audible alarm responsive to the detection signal. The audible alarm may be deactivated for a predetermined period of time responsive to at least one proximity detection signal.

14 Claims, 3 Drawing Sheets

(56) References Cited

U.S. PATENT DOCUMENTS

| | | | | |
|---|---|---|---|---|
| 4,857,895 | A | 8/1989 | Kaprelian | |
| 4,897,798 | A | 1/1990 | Cler | |
| 4,975,684 | A * | 12/1990 | Guttinger et al. | 340/587 |
| 5,088,645 | A | 2/1992 | Bell | |
| 5,211,332 | A | 5/1993 | Adams | |
| 5,240,178 | A | 8/1993 | Dewolf et al. | |
| 5,244,146 | A | 9/1993 | Jefferson et al. | |
| 5,250,904 | A * | 10/1993 | Salander et al. | 324/430 |
| 5,395,042 | A | 3/1995 | Riley et al. | |
| 5,476,221 | A | 12/1995 | Seymour | |
| 5,499,196 | A | 3/1996 | Pacheco | |
| 5,555,927 | A | 9/1996 | Shah | |
| 5,611,484 | A | 3/1997 | Uhrich | |
| 5,801,625 | A * | 9/1998 | Wang | 340/506 |
| 5,808,294 | A | 9/1998 | Neumann | |
| 5,902,183 | A | 5/1999 | D'Souza | |
| 5,909,378 | A | 6/1999 | De Milleville | |
| 5,918,474 | A | 7/1999 | Khanpara et al. | |
| 5,977,964 | A | 11/1999 | Williams et al. | |
| 6,062,482 | A | 5/2000 | Gauthier et al. | |
| 6,066,843 | A | 5/2000 | Scheremeta | |
| 6,095,427 | A | 8/2000 | Hoium et al. | |
| 6,098,893 | A | 8/2000 | Berglund et al. | |
| 6,111,511 | A | 8/2000 | Sivathanu et al. | |
| 6,216,956 | B1 | 4/2001 | Ehlers et al. | |
| 6,349,883 | B1 | 2/2002 | Simmons et al. | |
| 6,356,204 | B1 | 3/2002 | Guindi et al. | |
| 6,370,894 | B1 | 4/2002 | Thompson et al. | |
| 6,415,205 | B1 | 7/2002 | Myron et al. | |
| 6,478,233 | B1 | 11/2002 | Shah | |
| 6,619,055 | B1 | 9/2003 | Addy | |
| 6,645,066 | B2 | 11/2003 | Gutta et al. | |
| 6,769,482 | B2 | 8/2004 | Wagner et al. | |
| 6,990,821 | B2 | 1/2006 | Singh et al. | |
| 7,024,336 | B2 | 4/2006 | Salsbury et al. | |
| 7,109,879 | B2 | 9/2006 | Stults et al. | |
| 7,149,729 | B2 | 12/2006 | Kaasten et al. | |
| 7,188,482 | B2 | 3/2007 | Sadegh et al. | |
| 7,379,791 | B2 | 5/2008 | Tamarkin et al. | |
| RE40,437 | E | 7/2008 | Rosen | |
| 7,469,550 | B2 | 12/2008 | Chapman, Jr. et al. | |
| 7,579,945 | B1 | 8/2009 | Richter et al. | |
| 7,623,028 | B2 | 11/2009 | Kates | |
| 7,644,869 | B2 | 1/2010 | Hoglund et al. | |
| 7,702,424 | B2 | 4/2010 | Cannon et al. | |
| 7,784,704 | B2 | 8/2010 | Harter | |
| 7,802,618 | B2 | 9/2010 | Simon et al. | |
| 7,848,900 | B2 | 12/2010 | Steinberg et al. | |
| 7,854,389 | B2 | 12/2010 | Ahmed | |
| 7,994,928 | B2 | 8/2011 | Richmond | |
| 8,010,237 | B2 | 8/2011 | Cheung et al. | |
| 8,016,205 | B2 | 9/2011 | Drew | |
| 8,019,567 | B2 | 9/2011 | Steinberg et al. | |
| 8,037,022 | B2 | 10/2011 | Rahman et al. | |
| 8,090,477 | B1 | 1/2012 | Steinberg | |
| 8,091,375 | B2 | 1/2012 | Crawford | |
| 8,098,166 | B2 | 1/2012 | Lang | |
| 8,131,497 | B2 | 3/2012 | Steinberg et al. | |
| 8,174,381 | B2 | 5/2012 | Imes et al. | |
| 8,180,492 | B2 | 5/2012 | Steinberg | |
| 8,219,249 | B2 | 7/2012 | Harrod et al. | |
| 2001/0038337 | A1 * | 11/2001 | Wickstead et al. | 340/628 |
| 2004/0164238 | A1 | 8/2004 | Xu et al. | |
| 2004/0249479 | A1 | 12/2004 | Shorrock | |
| 2005/0090915 | A1 | 4/2005 | Geiwitz | |
| 2005/0128067 | A1 | 6/2005 | Zakrewski | |
| 2005/0150968 | A1 | 7/2005 | Shearer | |
| 2005/0189429 | A1 | 9/2005 | Breeden | |
| 2005/0192915 | A1 | 9/2005 | Ahmed et al. | |
| 2005/0280421 | A1 | 12/2005 | Yomoda et al. | |
| 2006/0186214 | A1 | 8/2006 | Simon et al. | |
| 2006/0196953 | A1 | 9/2006 | Simon et al. | |
| 2007/0080819 | A1 * | 4/2007 | Marks et al. | 340/628 |
| 2007/0115902 | A1 | 5/2007 | Shamoon et al. | |
| 2007/0205297 | A1 | 9/2007 | Finkam et al. | |
| 2007/0266575 | A1 | 11/2007 | Nash | |
| 2008/0015742 | A1 | 1/2008 | Kulyk et al. | |
| 2008/0183335 | A1 | 7/2008 | Poth et al. | |
| 2008/0191045 | A1 | 8/2008 | Harter | |
| 2008/0273754 | A1 | 11/2008 | Hick et al. | |
| 2008/0317292 | A1 | 12/2008 | Baker et al. | |
| 2009/0171862 | A1 | 7/2009 | Harrod et al. | |
| 2009/0254225 | A1 | 10/2009 | Boucher et al. | |
| 2009/0259713 | A1 | 10/2009 | Blumrich et al. | |
| 2009/0297901 | A1 | 12/2009 | Kilian et al. | |
| 2009/0327354 | A1 | 12/2009 | Resnick et al. | |
| 2010/0019051 | A1 | 1/2010 | Rosen | |
| 2010/0025483 | A1 | 2/2010 | Hoeynck et al. | |
| 2010/0070084 | A1 | 3/2010 | Steinberg et al. | |
| 2010/0070086 | A1 | 3/2010 | Harrod et al. | |
| 2010/0070234 | A1 | 3/2010 | Steinberg et al. | |
| 2010/0084482 | A1 | 4/2010 | Kennedy et al. | |
| 2010/0167783 | A1 | 7/2010 | Alameh et al. | |
| 2010/0179704 | A1 | 7/2010 | Ozog | |
| 2010/0211224 | A1 | 8/2010 | Keeling et al. | |
| 2010/0238036 | A1 | 9/2010 | Holcombe | |
| 2010/0262298 | A1 | 10/2010 | Johnson et al. | |
| 2010/0262299 | A1 | 10/2010 | Cheung et al. | |
| 2010/0280667 | A1 | 11/2010 | Steinberg | |
| 2010/0289643 | A1 | 11/2010 | Trundle et al. | |
| 2010/0308119 | A1 | 12/2010 | Steinberg et al. | |
| 2010/0318227 | A1 | 12/2010 | Steinberg et al. | |
| 2011/0046792 | A1 | 2/2011 | Imes et al. | |
| 2011/0046805 | A1 | 2/2011 | Bedros et al. | |
| 2011/0046806 | A1 | 2/2011 | Nagel et al. | |
| 2011/0077896 | A1 | 3/2011 | Steinberg et al. | |
| 2011/0151837 | A1 | 6/2011 | Winbush, III | |
| 2011/0160913 | A1 | 6/2011 | Parker et al. | |
| 2011/0185895 | A1 | 8/2011 | Freen | |
| 2011/0307103 | A1 | 12/2011 | Cheung et al. | |
| 2011/0307112 | A1 | 12/2011 | Barrilleaux | |
| 2012/0017611 | A1 | 1/2012 | Coffel et al. | |
| 2012/0065935 | A1 | 3/2012 | Steinberg et al. | |
| 2012/0085831 | A1 | 4/2012 | Kopp | |
| 2012/0101637 | A1 | 4/2012 | Imes et al. | |
| 2012/0158350 | A1 | 6/2012 | Steinberg et al. | |
| 2012/0221151 | A1 | 8/2012 | Steinberg | |
| 2012/0252430 | A1 | 10/2012 | Imes et al. | |

FOREIGN PATENT DOCUMENTS

| | | |
|---|---|---|
| JP | 59106311 | 6/1984 |
| JP | 01252850 | 10/1989 |
| JP | 09298780 | 11/1997 |

OTHER PUBLICATIONS

Braeburn 5300 Installer Guide, Braeburn Systems, LLC, Dec. 9, 2009, 10 pages.

Braeburn Model 5200, Braeburn Systems, LLC, Jul. 20, 2011, 11 pages.

Ecobee Smart Si Thermostat Installation Manual, Ecobee, Apr. 3, 2012, 40 pages.

Ecobee Smart Si Thermostat User Manual, Ecobee, Apr. 3, 2012, 44 pages.

Ecobee Smart Thermostat Installation Manual, Jun. 29, 2011, 20 pages.

Ecobee Smart Thermostat User Manual, May 11, 2010, 20 pages.

Electric Heat Lock Out on Heat Pumps, Washington State University Extension Energy Program, Apr. 2010, pp. 1-3.

Honeywell Installation Guide FocusPRO TH6000 Series, Honeywell International, Inc., Jan. 5, 2012, 24 pages.

Honeywell Operating Manual FocusPRO TH6000 Series, Honeywell International, Inc., Mar. 25, 2011, 80 pages.

Honeywell Prestige IAQ Product Data 2, Honeywell International, Inc., Jan. 12, 2012, 126 pages.

Honeywell Prestige THX9321 and TXH9421 Product Data, Honeywell International, Inc., 68/0311, Jan. 2012, 126 pages.

Honeywell Prestige THX9321-9421 Operating Manual, Honeywell International, Inc., Jul. 6, 2011, 120 pages.

Hunter Internet Thermostat Installation Guide, Hunter Fan Co., Aug. 14, 2012, 8 pages.

(56) References Cited

OTHER PUBLICATIONS

Introducing the New Smart Si Thermostat, Datasheet [online]. Ecobee, Mar. 2012 [retrieved on Feb. 25, 2013]. Retrieved from the Internet: <URL: https://www.ecobee.com/solutions/home/smart-si/>, Mar. 12, 2012, 4 pages.
Lennox ComfortSense 5000 Owners Guide, Lennox Industries, Inc., Feb. 2008, 32 pages.
Lennox ComfortSense 7000 Owners Guide, Lennox Industries, Inc., May 2009, 15 pages.
Lennox iComfort Manual, Lennox Industries, Inc., Dec. 2010, 20 pages.
Lux PSPU732T Manual, Lux Products Corporation, Jan. 6, 2009, 48 pages.
NetX RP32-WiFi Network Thermostat Consumer Brochure, Network Thermostat, May 2011, 2 pages.
NetX RP32-WiFi Network Thermostat Specification Sheet, Network Thermostat, Feb. 28, 2012, 2 pages.
RobertShaw Product Manual 9620, Maple Chase Company, Jun. 12, 2001, 14 pages.
RobertShaw Product Manual 9825i2, Maple Chase Company, Jul. 17, 2006, 36 pages.
SA720 Smoke Alarm User Manual, First Alert, Aug. 2007, 6 pages.
Smoke Alarm User Manual, Kidde, i9060, Dec. 1, 2009, 2 pages.
SYSTXCCUIZ01-V Infinity Control Installation Instructions, Carrier Corp, May 31, 2012, 20 pages.
T8611G Chronotherm IV Deluxe Programmable Heat Pump Thermostat Product Data, Honeywell International Inc., Oct. 1997, 24 pages.
TB-PAC, TB-PHP, Base Series Programmable Thermostats, Carrier Corp, May 14, 2012, 8 pages.
The Perfect Climate Comfort Center PC8900A W8900A-C Product Data Sheet, Honeywell International Inc, Apr. 2001, 44 pages.
TP-PAC, TP-PHP, TP-NAC, TP-NHP Performance Series AC/HP Thermostat Installation Instructions, Carrier Corp, Sep. 2007, 56 pages.
Trane Communicating Thermostats for Fan Coil, Trane, May 2011, 32 pages.
Trane Communicating Thermostats for Heat Pump Control, Trane, May 2011, 32 pages.
Trane Install XL600 Installation Manual, Trane, Mar. 2006, 16 pages.
Trane XL950 Installation Guide, Trane, Mar. 2011, 20 pages.
Venstar T2900 Manual, Venstar, Inc., Apr. 2008, 113 pages.
Venstar T5800 Manual, Venstar, Inc., Sep. 7, 2011, 63 pages.
VisionPRO TH8000 Series Installation Guide, Honeywell International, Inc., Jan. 2012, 12 pages.
VisionPRO TH8000 Series Operating Manual, Honeywell International, Inc., Mar. 2011, 96 pages.
VisionPRO Wi-Fi Programmable Thermostat, Honeywell International, Inc. Operating Manual, Aug. 2012, 48 pages.
White Rodgers (Emerson) Model 1F81-261 Installation and Operating Instructions, White Rodgers, Apr. 15, 2010, 8 pages.
White Rodgers (Emerson) Model IF98EZ-1621 Homeowner's User Guide, White Rodgers, Jan. 25, 2012, 28 pages.
Allen et al., "Real-Time Earthquake Detection and Hazard Assessment by ElarmS Across California", Geophysical Research Letters, vol. 36, L00B08, 2009, pp. 1-6.
Deleeuw, "Ecobee WiFi Enabled Smart Thermostat Part 2: The Features Review", Retrieved from <URL: http://www.homenetworkenabled.com/content.php?136-ecobee-WiFi-enabled-Smart-Thermostat-Part-2-The-Features-review>, Dec. 2, 2011, 5 pages.
Gao et al., "The Self-Programming Thermostat: Optimizing Setback Schedules Based on Home Occupancy Patterns", In Proceedings of the First ACM Workshop on Embedded Sensing Systems for Energy-Efficiency in Buildings, Nov. 3, 2009, 6 pages.
Loisos et al., "Buildings End-Use Energy Efficiency: Alternatives to Compressor Cooling", California Energy Commission, Public Interest Energy Research, Jan. 2000, 80 pages.
Lu et al., "The Smart Thermostat: Using Occupancy Sensors to Save Energy in Homes", In Proceedings of the 8th ACM Conference on Embedded Networked Sensor Systems, Nov. 3-5, 2010, pp. 211-224.
Mozer, "The Neural Network House: An Environmental that Adapts to its Inhabitants", AAAI Technical Report SS-98-02, 1998, pp. 110-114.
Rauchwarnmelder, Installation and User Manual [online]. GIRA [retrieved on Mar. 8, 2013]. Retrieved from the Internet: <URL: http://download.gira.de/data2/23301210.pdf>.
Rauchwarnmelder, Datasheet [online]. GIRA [retrieved on Mar. 7, 2013]. Retrieved from the Internet: <URL: http://www.gira.de/gebaeudetechnik/produkte/sicherheit/rauchmelder/rauchwarnmelderdualvds.html>, 14 pages.
Rauchwarnmelder, Design [online]. GIRA [retrieved on Mar. 7, 2013]. Retrieved from the Internet: <URL: http://www.gira.de/gebaeudetechnik/produkte/sicherheit/rauchmelder/rauchwarnmelderdualvds.html?vid=1145>, 7 pages.

* cited by examiner

USE OF OPTICAL REFLECTANCE PROXIMITY DETECTOR FOR NUISANCE MITIGATION IN SMOKE ALARMS

CROSS-REFERENCE TO RELATED APPLICATIONS

This application claims the benefit of U.S. Provisional Application for Patent Ser. No. 61/162,193, filed on Mar. 20, 2009, and entitled "USE OF OPTICAL REFLECTANCE PROXIMITY DETECTOR FOR NUISANCE MITIGATION IN SMOKE ALARMS," the specification of which is incorporated herein by reference.

TECHNICAL FIELD

The present invention relates to smoke alarms, and more particularly to smoke alarms including proximity detectors for controlling operation of the smoke alarm.

BACKGROUND

Smoke alarms are utilized for detecting and warning the inhabitants of a home or other occupied location of the existence of smoke which may indicate a fire. Upon detection of the smoke by the smoke alarm, the device emits a shrill, loud alarm that notifies all individuals within the area that smoke has been detected and departure from the premises may be necessary.

While the smoke alarms are very effective at notifying individuals of the possible existence of fire that is generating the smoke, certain types of false alarm indications may often be very annoying to a user. These false alarms may be triggered, for example, by smoke generation within the kitchen during preparation of a meal. This may cause the creation of enough smoke that will set off the smoke alarm causing the loud, shrill alarm. In this case, a fire that is dangerous and out of control is not of concern to the residents so the loud, shrill smoke alarm will provide more of an annoyance than a benefit. Presently, there exists no method for easily discontinuing the loud, shrill alarm other than fanning the atmosphere in the area of the smoke alarm in an attempt to remove the smoke from the area that is causing the smoke alarm to activate or removing the battery or house power from the smoke alarm in order to turn it off. Removal of the power source may be difficult as smoke alarms are usually mounted upon the ceiling or other high area of the house or building to provide maximum smoke detection capabilities.

An additional problem with existing smoke alarms is the battery check or low battery condition. In smoke alarms that are powered by batteries, it is often necessary to periodically check the battery within the smoke alarm in order to confirm that the battery has sufficient charge. This often requires obtaining a ladder or chair for the user to reach the smoke alarm which has been placed in a substantially high location within the home or building to maximize smoke detection capabilities. The user is required to push a button that is located on the smoke alarm to perform a battery check. An audible signal is provided for an indication of whether or not the battery is in need of replacement.

An additional related problem relates to the low battery condition within a smoke alarm. When the battery reaches a low power condition, the smoke alarm will commonly beep at a low duty cycle of around once per minute. Unfortunately, this beep often occurs in early morning hours when the house temperature is at a minimum and these conditions maximize the low battery condition and increase the likelihood of an alarm. This is of course a most irritating time for this to occur. Additionally, the beep is very difficult to locate since the beep is short and a single high frequency tone. The beep is short to enable up to a week or more of low power battery alert on a mostly depleted battery. The alert transducer uses a single high frequency, typically around 3 kilohertz due to the need to produce a very high output from a small transducer which necessitates the use of a high frequency resonate transducer. Due to the reflections and use of half wavelengths shorter than the distance between the human ears, it is very difficult to localize the source which may present a problem since most homes normally include a number of smoke alarms.

Thus, there is a need to provide an improved method for temporarily mitigating an undesired activation of a smoke alarm and to provide battery check capabilities within the smoke alarm.

SUMMARY

The present invention, as disclosed and described herein, in one aspect thereof, comprises smoke detection circuitry for detecting smoke and generating a detection signal responsive thereto. Proximity detection circuitry generates a proximity detection signal responsive to the detection of an object within in a selected distance of the smoke alarm. Alarm generation circuitry generates an audible alarm responsive to the detection signal. The audible alarm may be deactivated for a predetermined period of time responsive to at least one proximity detection signal.

BRIEF DESCRIPTION OF THE DRAWINGS

For a more complete understanding, reference is now made to the following description taken in conjunction with the accompanying Drawings in which.

DETAILED DESCRIPTION

Figure 1:
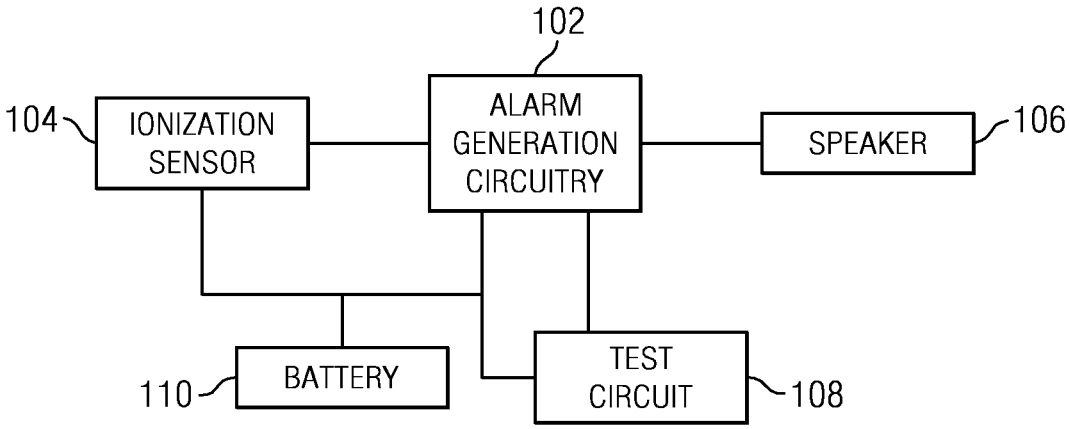
FIG. 1 is a block diagram of a ionization type smoke alarm.

Referring now to the drawings, wherein like reference numbers are used herein to designate like elements throughout, the various views and embodiments of a smoke alarm having proximity detection operation mode are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to the drawings, and more particularly to FIG. 1, there is illustrated a functional block diagram of a first type of smoke alarm. The smoke alarm of FIG. 1 utilizes ionization detection to detect smoke. The alarm generation circuitry 102 is associated with an ionization sensor 104. The ionization sensor 104 detects particles of smoke using a small amount of radioactive americium 241. The radiation generated by the americium 241 passes through an ionization chamber within the ionization sensor 104. The ionization chamber comprises an air-filled space between two electrodes that permit a small constant current between the electrodes. Any smoke that enters the chamber absorbs the alpha particles emitted by the americium 241 which reduces the ionization and interrupts the current between the electrodes. When this condition is detected, the ionization sensor 104 generates an alarm signal to the alarm circuitry 102 that generates an audible alarm signal that is provided to the speaker 106. Associated with the ionization type smoke alarm is test circuitry 108 that enables testing of the present charge level associated with the battery 110. The battery 110 provides power to the ionization sensor 104, alarm generation circuitry 102, speaker 106 and test circuit 108 to power the smoke alarm.

Figure 2:
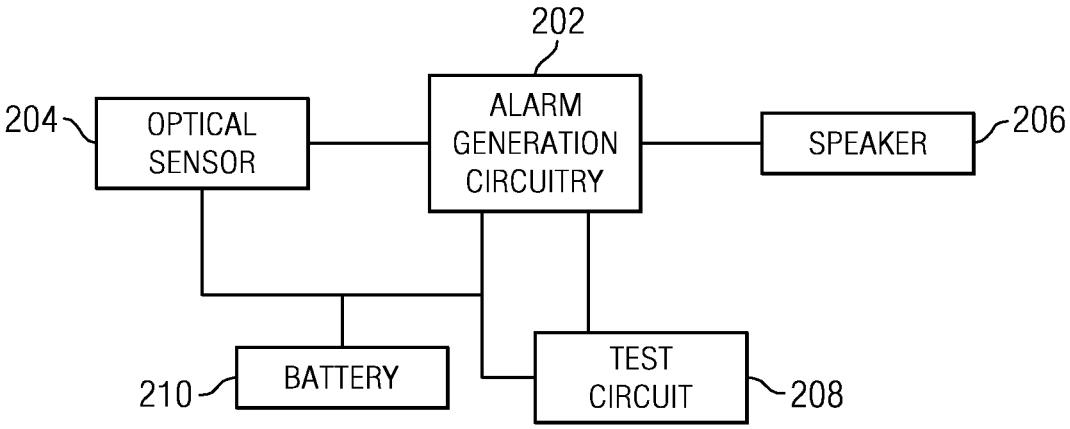
FIG. 2 is a block diagram of an optical type smoke alarm.

Referring now also to FIG. 2, there is illustrated an alternative type of smoke alarm circuitry comprising an optical smoke alarm. The optical smoke alarm also includes alarm generation circuitry 202 that is responsive to smoke detection signals provided by an optical sensor 204. The optical sensor 204 includes a light sensor that includes a light source which may comprise an incandescent bulb or infrared LED, a lens to collimate the light into a beam and a photo diode or other photoelectric sensor for detecting light from the light source. In the absence of smoke, the light passes in front of the detector in a straight line. When smoke enters the optical chamber of the optical sensor 204 across the path of the light beam, some light is scattered by the smoke particles redirecting them at the photo diode or photo sensor, and thus triggering generation of an alarm signal to the alarm circuitry 202. The alarm generation circuitry 202 will generate the audible alarm signal to the speaker 206 associated with the alarm circuitry 202. As with the ionization circuit, the optical smoke alarm utilizes a test circuit 208 to test the charge on the battery 210. The battery 210 is responsible for powering all of the components of the optical smoke alarm including the alarm circuitry 202, optical sensor 204, speaker 206 and test circuit 208.

As described previously, some issues arising with existing smoke alarms, be they ionization or optical type smoke alarms, arise from the creation of false alarm situations such as, for example, when a small amount of smoke is created within the kitchen due to burning toast, food falling on the heating element of the oven, etc., or the ability to quickly and easily check the battery charge using the test circuitry. Presently, mitigation of an alarm requires disconnection of the power source to the smoke alarm in order to discontinue an undesired alarm. Additionally, any type of test of the battery charge requires pushing of a button on the external surface of the smoke alarm that requires the user to be able to physically touch the smoke alarm. This often presents a great challenge since either removing power sources to discontinue an undesired alarm or pressing a button to perform battery test operations require the user to get out a ladder or stand on a chair to access the smoke alarm placed in a high location to ensure its optimal performance.

Figure 3:
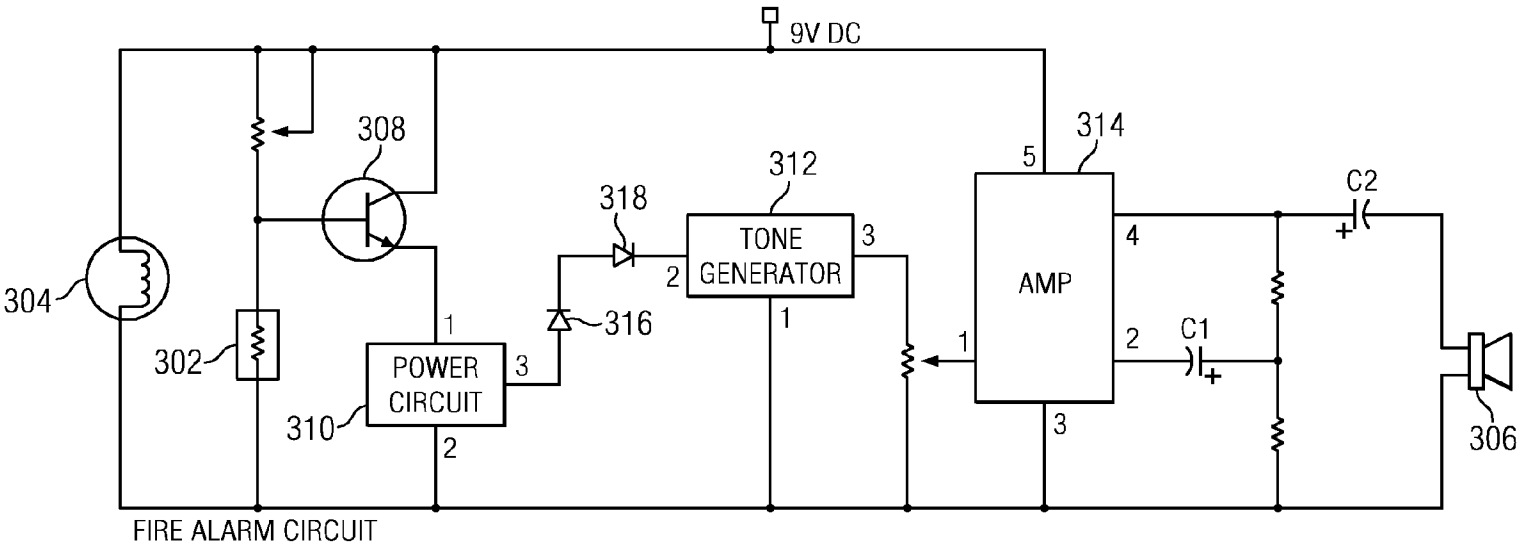
FIG. 3 is a more detailed circuit diagram of an optical type smoke alarm.

FIG. 3 illustrates a schematic diagram of an optical smoke detection alarm based upon an LDR (light detecting resistor) 302 and lamp 304 pair for sensing smoke. The alarm works by sensing the smoke produced during a fire. The circuit produces an audible alarm from speaker 306 when smoke is detected. When there is no smoke, the light from the lamp 304 falls directly upon the LDR 302. The LDR resistance will be low, and the voltage across the LDR will be below 0.6 volts. Transistor 308 will be turned off in this state and the circuit is inactive. When there is sufficient smoke to mask the light from the lamp 304 falling on the LDR 302, the LDR 302 resistance increases and so does the voltage across the LDR. This will cause the voltage at the gate of transistor 308 to increase and turn on transistor 308. This provides a voltage to power circuit 310 which generates a 5 volt signal to a tone generator 312. The tone signal from tone generator 312 is amplified by an amplifier 314 which is used to drive the speaker 306. Diodes 316 and 318 are used to drop the voltage input to the tone generator 312 from the power circuit 310.

Figure 4:
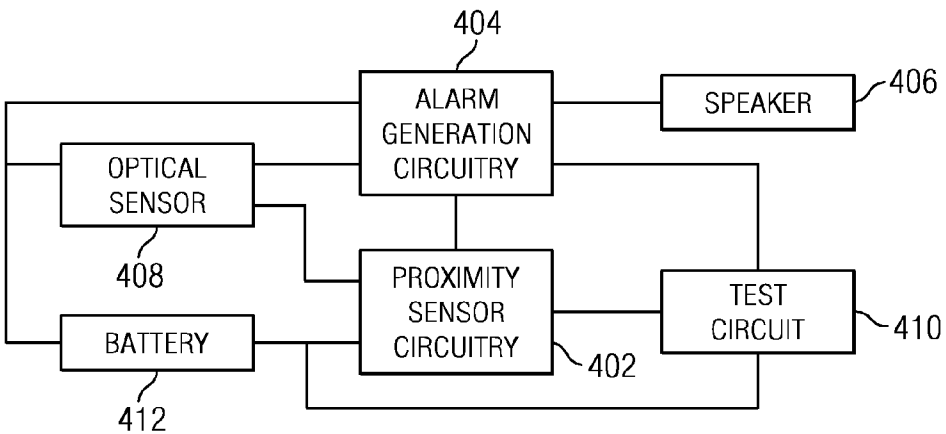
FIG. 4 illustrates a block diagram of a smoke alarm including proximity sensor operation capabilities according to the present disclosure.

Referring now to FIG. 4, there is illustrated a block diagram of a circuit which enables a user to utilize proximity detection circuitry for temporarily abating an undesired alarm or performing battery test operations rather than using previously described processes. While the implementation with respect to FIG. 4 describes the use of proximity sensor circuitry 402 within an optical type smoke alarm, the proximity sensor circuitry 402 could also be implemented within the ionization type circuitry described hereinabove. The smoke alarm detection capabilities of the smoke alarm of FIG. 4 operate in a similar manner to the optical alarm described previously. Alarm generation circuitry 404 generates alarm signals to a speaker 406 responsive to smoke detection signals received from optical sensor 408. The optical sensor 408 generates the smoke detection signal to the alarm generation circuitry 404 in the same manner as that described previously with respect to the optical smoke alarm of FIG. 2.

The optical sensor 408 in addition to detecting smoke is used for detecting the proximity of a user's hand or other item in conjunction with the proximity sensor circuitry 402. The proximity sensor circuitry 402 detects when a hand or for example, a broom or other item are being waved in close proximity to the smoke alarm. The optical sensor 408 comprises a short-range (approximately 6 inches) optical proximity sensor that in conjunction with the proximity sensor circuitry 402 may be used to control operations of the smoke alarm with either the wave of a hand or some other readily available object such as a broom. The test circuitry 410 enables testing of the charge within a battery 412. The battery 412 provides power to each of the components within the smoke alarm circuit.

Figure 5:
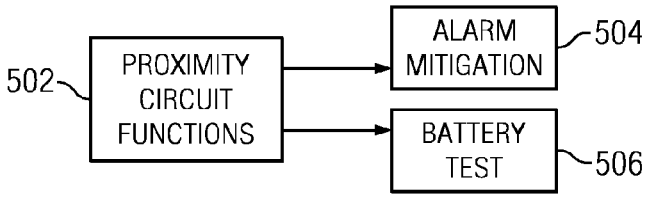
FIG. 5 illustrates the various functionalities associated with the smoke alarm including proximity sensor modes of operation.

Utilizing a combination of the proximity sensor circuitry 402, optical sensor 408 and alarm generation circuitry 404, the smoke alarm may provide a number of proximity controller functionalities. These are generally illustrated in FIG. 5. A number of proximity controlled functions 502 may be provided using the proximity sensor 402. The proximity controlled functions include the alarm mitigation function 504 and the battery test function 506. The alarm mitigation function 504 enables a temporary discontinuation of the audible alarm in situations when an undesired activation of the alarm has occurred. This would occur for example, when a small amount of smoke created within a kitchen that does not indicate a fire or emergency condition has been created. The proximity sensor of the smoke alarm is activated when an object such as a hand or a broom is brought close to the optical sensor 408. If the smoke alarm has been activated due to kitchen smoke or other situations that have been resolved by human intervention, proximity detection would enable the user to disable the smoke alarm for a short period of time, such as 3 minutes, to allow the area around the smoke alarm to air out. A double wave or other more complex detection by the proximity sensor circuitry 402 and optical sensor 408 may be accomplished in a short period of time, such as less than 10 seconds in order to enable assurances that the detection was for a desired mitigation of the alarm and not some type of random event occurring during actual smoke detection.

In order to assist a user in temporarily mitigating the alarm, a momentary change in the audible alarm would be desirable for each proximity event that has been detected by the optical sensor 408 and proximity sensor circuit 402. This would assist the user in knowing whether they had accurately or inaccurately waved their hand or broom in the area of the smoke alarm and provide for an audible indication of aiming feedback with respect to the proximity detection. After the appropriate combination of proximity detection events have been detected by the optical sensor 408 and proximity sensor circuit 402, the audible alarm would be temporarily discontinued.

The smoke alarm commonly beeps at a low duty cycle of around once per minute when the battery 412 has its charge fall below a predetermined level. These beeps can often be very difficult to locate since the beep is short and comprises a single high frequency tone. The beep is short to enable up to a week or more of low battery alerts to be created on an almost depleted battery. The alert transducer uses a single high frequency chirp typically around 3 kilohertz due to the need to produce a very high output from a small transducer. This necessitates the use of a high frequency resonate transducer. Due to the reflections and the use of a half wavelength shorter than the distance between the human ear, it is often very difficult to locate the source requiring the user to check each smoke alarm within the house requiring a great deal of time.

The battery test functionality 506 enables a battery test operation to be performed on the battery 412 within the smoke alarm without having to manually press a button on the smoke alarm. The battery test functionality 506 can be utilized in two situations. When a low battery charge chirp is being emitted by the smoke alarm, the low battery test functionality 506 may be used to determine whether a particular smoke alarm has a low battery charge or whether the battery presently has sufficient charge. The battery test functionality 506 would similarly be useful for performing the periodic battery charge tests that are required to ensure the smoke alarm is in working operation.

By utilizing the proximity sensor circuitry 402, if the smoke alarm has not been activated to indicate detection of smoke, the detection of a single proximity event from a hand or broom by the optical sensor 408 and proximity sensor circuitry 402 initiates a battery check test. If the battery 412 is weak, the test circuitry 410 will cause the production of a distinctive series of beeps or a distinctive tone to indicate a dying battery. If the battery 412 is sufficiently charged, a single short beep of a different tone may be created. Thus, if a user hears a low battery beep, they can use their broom or hand to quickly and easily check all of the smoke alarms within their home without having to climb up on a chair or ladder or remove the devices in order to press a detection button upon the smoke alarm.

As described previously, smoke alarms generally use either an ionization chamber or optical smoke detection circuitry or a combination of both to detect smoke. These differing techniques have distinct advantages and disadvantages. However, a high performance optical reflective detector implemented within the circuit of FIG. 4 including proximity sensor circuitry 402 can readily be adapted to detect reflectance from smoke and to provide proximity detection data since both detections are equivalent low reflectance functions. The proximity detector is more sophisticated since it must deal with ambient light while the conventional optical smoke detector does not have to cancel ambient light since it looks for reflections from smoke in an optically baffled compartment which blocks out ambient light but allows the entry of smoke. A reflectance proximity detector can drive two different LEDs, one for proximity detection and the other for smoke detection within the optical sensor 408. A light pipe can provide a signal from the baffled smoke detector and also from the outside proximity view. Depending on which LED is driven, the proximity detector is either for reflectance above a threshold for either the proximity detection or for smoke and of course giving a different alarm response. Optionally, an auxiliary photo diode can be used for the smoke detector portion to avoid artifacts or issues arising from ambient light. Because the proximity detection technology uses a low duty cycle controller to make proximity detection measurements every second or so, this low duty cycle controller can also be used for the low duty cycle smoke controller which is beneficial for reducing battery charge consumption.

Figure 6:
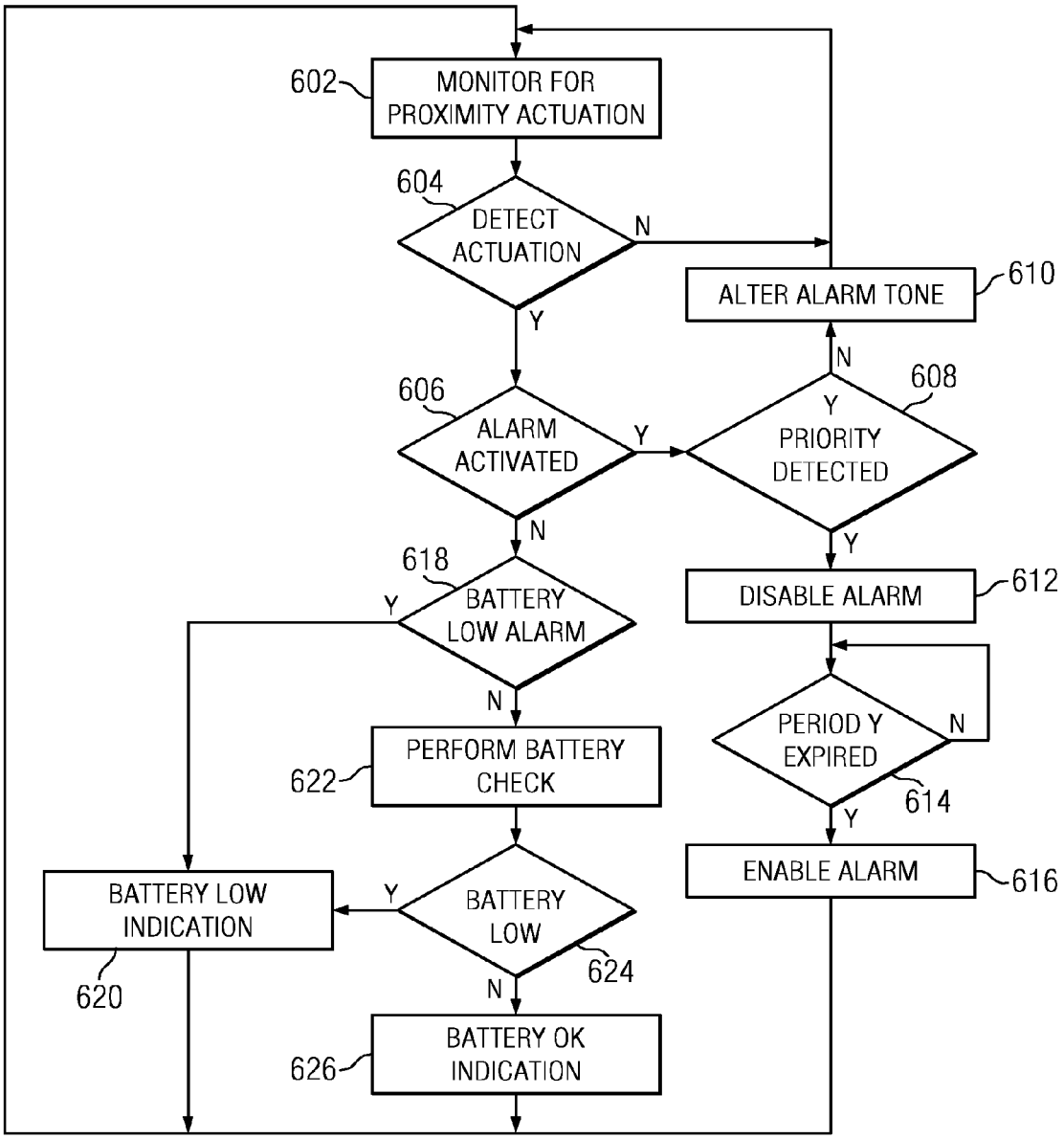
FIG. 6 is a flow diagram describing the operation of the smoke alarm including proximity sensor modes of operation.

Referring now to FIG. 6, there is illustrated a flow diagram describing the operation of the proximity detection controlled smoke alarm. Initially, at step 602, the optical sensor 408 and proximity sensor circuitry 402 monitor for a proximity actuation. Inquiry step 604 determines whether there has been a detection of a proximity actuation. If not, control passes back to step 602 to continue monitoring for a proximity actuation. Once a proximity actuation is detected, inquiry step 606 determines if the smoke alarm is presently activated. If so, control passes to inquiry step 608 which determines if a predetermined number of proximity activations have been detected. If not, the alarm tone provided by the smoke alarm may be altered at step 610 and control returns back to step 602 to continue monitoring for additional proximity activations. If inquiry step 608 determines that a predetermined number of proximity actuations have been detected, the smoke alarm is disabled at step 612. Inquiry step 614 monitors for the expiration of a selected period of time. If the period of time has not yet expired, the process remains at inquiry step 614. Once the predetermined period of time has expired, control passes to step 616, wherein the smoke alarm is re-enabled and control passes back to step 602 to continue monitoring for proximity actuation. Once the alarm is re-enabled, the smoke detector can monitor for smoke and react accordingly.

If inquiry step 606 determines that the smoke alarm is not presently activated, control passes to inquiry step 618 to make a determination if the battery low alarm is presently active for the smoke alarm. If so, a battery low indication is audibly provided from the smoke alarm at step 620. If the battery low alarm has not been activated, a battery charge check is performed at step 622. Inquiry step 624 determines whether the battery is in a low charge condition. If not, a battery OK audible indication is provided at step 626 to indicate a sufficient charge and control passes back to step 602. If inquiry step 624 determines that the battery is in a low charge condition, the battery low indication is provided at step 620 before control passes back to step 602 to monitor for additional proximity actuations.

The above-described solution provides a low cost intuitive battery alarm control system to limit nuisance alarms within the smoke alarm and enables ease of battery charge checking using a proximity detection control process. The system also improves safety since users often remove batteries or take down smoke alarms that are producing spurious alarms or low battery beeping alarms. Users will also take down unaffected smoke alarms since the user cannot localize the beep associated with the alarm and then do not replace the alarm. Consumers do not check battery levels if the smoke alarm is out of reach. Additionally, use of an optical reflection proximity control system is better than a capacitive proximity system since convenient hand extension devices such as brooms would not work to activate a capacitive sensor which senses a conductive object such as the human hand or body.

It will be appreciated by those skilled in the art having the benefit of this disclosure that this smoke alarm having proximity detection operation mode provides an improved method for controlling operation of a smoke alarm. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A smoke alarm, comprising:

smoke detection circuitry for detecting smoke and generating a smoke detection signal responsive thereto;

proximity detection circuitry for generating a proximity detection signal when the proximity detection circuitry detects a movement of an object within a selected distance of the smoke alarm; and alarm generation circuitry for generating an audible alarm responsive to the smoke detection signal, wherein the audible alarm is temporarily deactivated when at least two proximity detection signals are generated within a predetermined period of time and while the smoke detection signal is received.

2. The smoke alarm of claim 1, further comprising:

battery charge test circuitry for determining a charge level of a battery associated with the smoke alarm; and wherein the alarm generation circuitry generates a first audible indication when the charge level of the battery exceeds a predetermined level and generates a second audible indication when the charge level of the battery falls below the predetermined level.

3. The smoke alarm of claim 1, wherein the alarm generation circuitry generates the audible alarm at a first level responsive to a first proximity detection signal and generates the audible alarm at a second level responsive to a second proximity detection signal when the audible alarm is at the first level.

4. The smoke alarm of claim 1, wherein the smoke detection circuit comprises an optical detection circuit.

5. The smoke alarm of claim 1, wherein the smoke detection circuit comprises an ionization detection circuit.

6. A method for controlling operation of a smoke alarm, comprising:

detecting smoke with the smoke alarm;

generating an audible alarm responsive to detection of the smoke;

detecting movement of an object within a selected distance of the smoke alarm, wherein the movement is detected using a proximity detection circuit; and temporarily deactivating the audible alarm when at least two movements of the object are detected within a predetermined period of time and within the selected distance of the smoke detector and while detecting the smoke.

7. The method of claim 6, further comprising:

reactivating the audible alarm after another predetermined period of time when the smoke is still detected by the smoke alarm.

8. The method of claim 6, further comprising:

detecting movement of the object within the selected distance when an audible alarm is not being generated;

determining a charge level of a battery associated with the smoke alarm responsive to the detected movement;

generating a first audible indication when the charge level of the battery exceeds a predetermined level; and generating a second audible indication when the charge level of the battery falls below the predetermined level.

9. The method of claim 6, wherein the step of generating the audible alarm further includes:

generating the audible alarm at a first level responsive to a first detected movement of the object; and generating the audible alarm at a second level responsive to a second detected movement when the audible alarm is at the first level.

10. A method for controlling operation of a smoke alarm, comprising:

detecting smoke with the smoke alarm;

generating an audible alarm responsive to detection of the smoke;

detecting movement of an object within a selected distance of the smoke alarm, wherein the movement is detected using a proximity detection circuit; and controlling operation of the smoke alarm when at least two movements of the object are detected within a predetermined period of time and within the selected distance of the smoke alarm and while the smoke is detected.

11. The method of claim 10, wherein controlling operation of the smoke alarm further includes temporarily deactivating the audible alarm.

12. The method of claim 11, further comprising:

reactivating the audible alarm after another predetermined period of time when the smoke is still detected by the smoke alarm.

13. The method of claim 10, wherein controlling operation of the smoke detector further includes:

detecting movement of the object within the selected distance when an audible alarm is not being generated;

determining a charge level of a battery associated with the smoke alarm responsive to the detected movement;

generating a first audible indication when the charge level of the battery exceeds a predetermined level; and generating a second audible indication when the charge level of the battery falls below the predetermined level.

14. The method of claim 10, wherein generating the audible alarm further includes:

generating the audible alarm at a first level responsive to a first detected movement of the object; and generating the audible alarm at a second level responsive to a second detected movement when the audible alarm is at the first level.

* * * * *